United States Patent [19]

Schultz

[11] 4,239,011

[45] Dec. 16, 1980

[54] NEEDLEPOINT EMBROIDERING METHOD

[76] Inventor: Diane M. Schultz, P. O. Box 9742, Glendale, Calif. 91208

[21] Appl. No.: 13,619

[22] Filed: Feb. 21, 1979

[51] Int. Cl.[3] ..... D05C 3/00

[52] U.S. Cl. ..... 112/266.1

[58] Field of Search ..... 112/266.1, 1; 2/244

[56] References Cited

U.S. PATENT DOCUMENTS

| | | | |
|---|---|---|---|
| 207,141 | 8/1878 | Smith | 112/266.1 |
| 1,560,283 | 11/1925 | Mehlem | 112/266.1 |
| 2,141,560 | 12/1938 | Rudnick | 112/266.1 |
| 4,154,181 | 5/1979 | J. Massucci et al. | 112/266.1 |

*Primary Examiner*—Doris L. Troutman

*Attorney, Agent, or Firm*—Theodore H. Lassagne

[57] ABSTRACT

Patterns to be applied to a needlepoint design outlined on a canvas panel are first traced in stitch-length markings on a grid of the same mesh size as the canvas mesh size, delineated on a transparent sheet. This sheet is then laid over the canvas panel with its grid aligned with the threads of the panel and the pattern in the desired position thereon. Threads are then embroidered into the panel in alignment with traced pattern. Spacing of repeats of the pattern is effected by tracing at least two delineations of the pattern on the transparent sheet in their intended spacing.

5 Claims, 10 Drawing Figures

NEEDLEPOINT EMBROIDERING METHOD

BACKGROUND OF THE INVENTION

1. Field of the Invention

Needlepoint, in the present day sense of the word, includes all kinds of embroidery done on canvas, varieties being known as quickpoint; grospoint; petitpoint; Bargello, also known as Florentine, flame or Hungarian embroidery; and other repeat patterns. The coarseness of the canvas base varies from, for example, 3 threads to 7 threads to the inch in quickpoint to more than 20 threads to the inch in petitpoint.

The present invention relates to a novel method of copying selected patterns in needlepoint which avoids the difficulties inherent in the methods previously known and used.

2. Description of the Prior Art

Needlework is an ancient art, specimens having been found in Egyptian tombs dating back to the 15th century B.C. Needlepoint came into its own in China during the 12th century A.C. and presently is enjoying a revival following a decline attributed to the advent of machinery.

In needlepoint, the commonest practice is to copy the desired pattern by counting stitches and background threads, selecting appropriate kinds of stitches from a wide variety of known variations. Publications such as "Needlepoint by Design" by Lane, published by Charles Scribner's Sons, New York, 1970, and "The New World of Needlepoint" by Perrone, published by Random House, Inc., New York, 1972, describe known methods of needlepointing from photographs and charts, or graphs, of various patterns.

Previous efforts to avoid the necessity of counting stitches in the course of such work have involved adhering pattern sheets to the cloth to be decorated and stitching the delineated pattern through such sheets and the material, as in Rick et al. U.S. Pat. No. 2,756,434.

A need has existed, however, for a method and equipment meeting the special requirements of needlepoints for accurate placement of the required lengths and kinds of stitches required for the formation of pattern repeats positioned in a desired relationship to each other and to an overall design, and it is the object of the present invention to meet that need.

SUMMARY OF THE INVENTION

A needlepoint project consists essentially of the application of a variety of variously colored patterns to a canvas sheet on which a design has been delineated. This design comprises an outlined area or areas intended to be decorated by one or more patterns.

According to the present invention, at least two delineations of a pattern, called a "pattern repeat" are transferred from a source, such as a pattern card bearing cross-hatching congruent with the threads of the canvas to which the pattern is to be applied, to a pattern guide in the form of a congruently cross-hatched transparent sheet. This is done by overlaying the pattern guide on the pattern card, with their cross-hatchings in congruence, and tracing the pattern repeat onto the upper surface of the pattern guide. Preferably, this is done using a water-soluble film pen so that the tracings on the pattern guide may be erased and the guide reused.

The pattern guide bearing the copied pattern repeat is then laid upon the canvas and may be moved about freely to see exactly what the pattern will look like in various positions within the outlined area of the design in which it is to be reproduced.

When the pattern has been positioned approximately as desired, the horizontal and vertical lines of the pattern guide are superimposed upon the nearest horizontal and vertical threads of the underlying canvas, and a threaded needle is positioned from the back of the canvas in a selected hole at an edge of one of the pattern repeats. Removing the pattern guide, the needle is then pulled to the front of the canvas and the first stitch, of the length shown on the pattern guide, is completed. Following this, the remaining stitches required to complete application of the pattern repeat to the canvas are completed using the original chart for directions, if necessary, and the pattern guide for stitch placement.

Subsequent placements of additional repeats of the same pattern within the same design are effected by replacing the pattern guide so that one pattern delineation overlies one stitched on the canvas and another overlies an unstitched area, with the horizontal and vertical lines of the pattern guide overlying the canvas threads as before. A starting hole for an additional one of the pattern delineations is then located in the same manner as was the starting hole for the first one, and the additional pattern delineation is completed in the same way.

When the first pattern has been applied as many times as desired, the pattern guide is wiped with a damp cloth to erase the pattern repeat tracing from its surface. A second pattern repeat then may be traced onto the pattern guide and applied to the canvas just as was the first.

DESCRIPTION OF THE PREFERRED EMBODIMENTS

In the application of the method of the present invention, pattern cards are employed on which is delineated, first, a background grid the mesh size of which is the same as the mesh size of the canvas to which the pattern is to be transferred and, second, superimposed lines indicating where each stitch of the pattern repeat begins and ends; how long each stitch is in relation to the number of canvas threads (not holes) it crosses over; how many stitches are in each pattern repeat and the direction in which they are worked; i.e., horizontally, vertically or diagonally. If all pattern repeats are stitched the same, no matter in what color or colors, only one repetition of the pattern is diagrammed on the pattern card and successive repetitions of it are properly located as hereinafter described.

Figure 1:
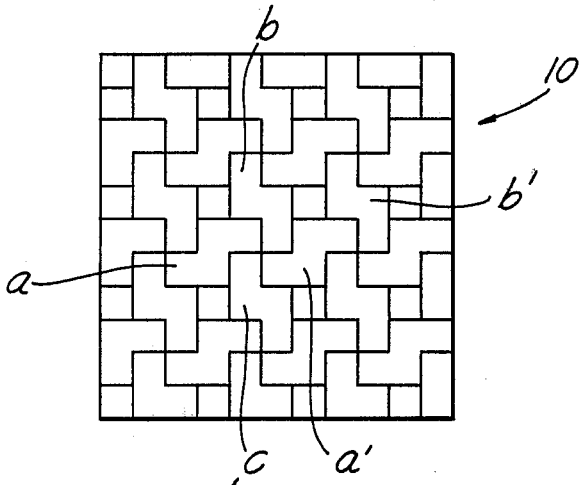
FIG. 1 is an illustration of a simple pattern.

For example, as shown in FIG. 1, the pattern repeat 10 consists of a first delineation of the pattern consisting of area a and area b; a second delineation of the same pattern consisting of area a' and area b' and a third area c which is unnecessary in the case of certain types of patterns but desirable for orientation of adjacent repeats in the case of this pattern.

Figure 3:
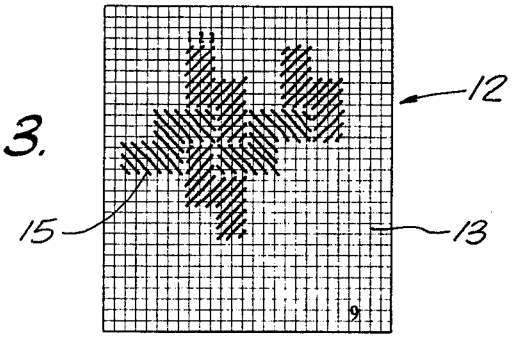
FIG. 3 is an illustration of a pattern card for the application of a pattern such as that of FIG. 1.

A pattern card 12 (FIG. 3) has delineated thereon a background grid 13 of the same mesh size as the canvas to which the pattern is to be applied, and superimposed thereon are lines 15 indicating where each stitch of the pattern begins and ends; how long each stitch is in relation to the number of canvas threads (corresponding to the lines of grid 13) it crosses over; how many stitches are in each pattern repeat; and the direction in which they are worked.

The delineation of the stitches appearing on the pattern cards is the same for all types of stitches, leaving the user free to choose any of the various types of stitches; e.g., Continental, Scotch, Florentine, etc. in applying the pattern to the fabric.

Figure 5:
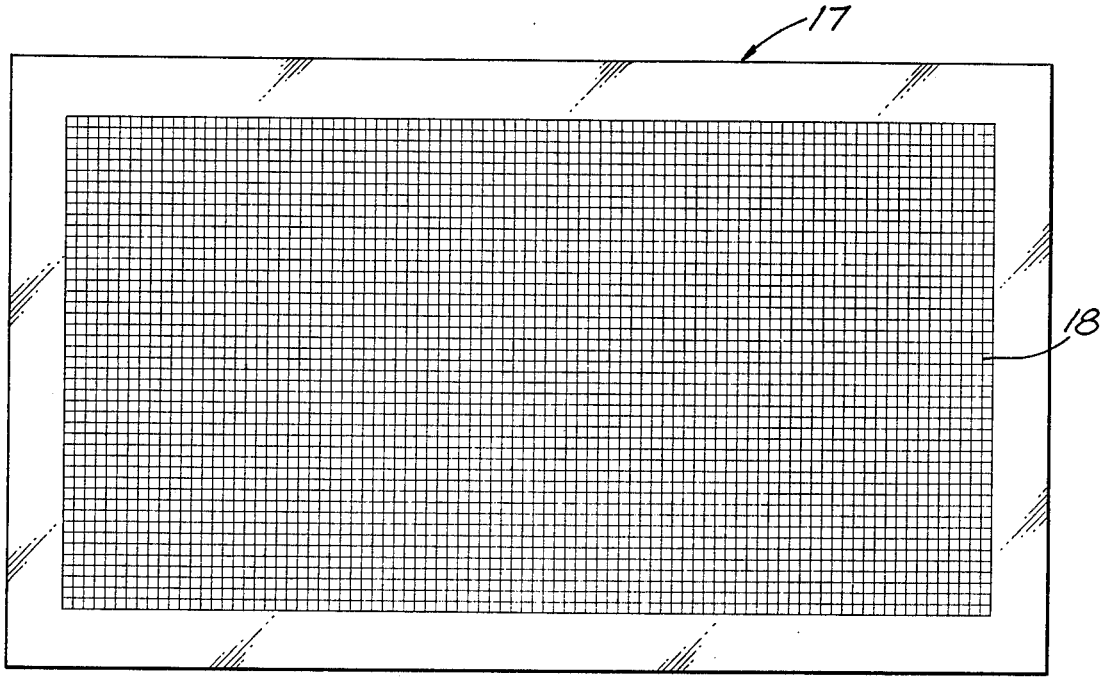
FIG. 5 is an illustration of a transparent pattern guide employed in carrying out the present invention.

In applying such a pattern to a fabric base such as a canvas, a template in the form of a pattern guide 17 (FIG. 5) is employed. This is a sheet of transparent material, such as acetate, which has delineated thereon a grid 18 of the same mesh size as the grid 13 although larger in its longitudinal and vertical dimensions. With the pattern guide 17 laid over the pattern card 12 and the grids 13 and 18 congruent, the stitch lines 15 are traced on the upper surface of the pattern guide 17, preferably using a water soluble film pen so that the tracings may be washed off when the pattern guide is to be reused for a different pattern.

Figure 6:
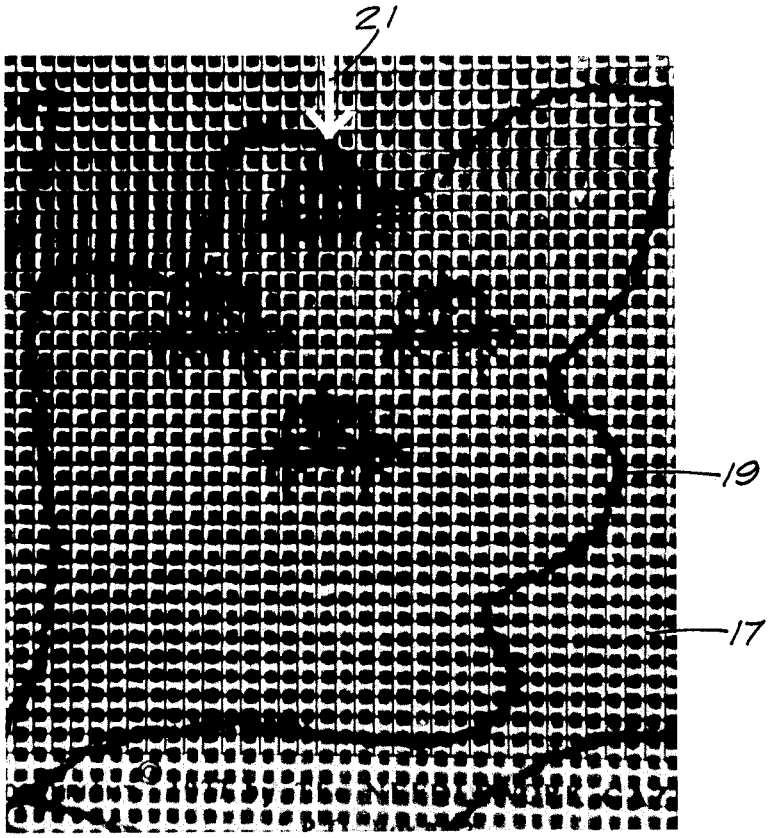
FIG. 6 is an illustration showing the technique of locating the starting hole for a pattern stitch in the canvas with the pattern guide overlaid.
Figure 7:
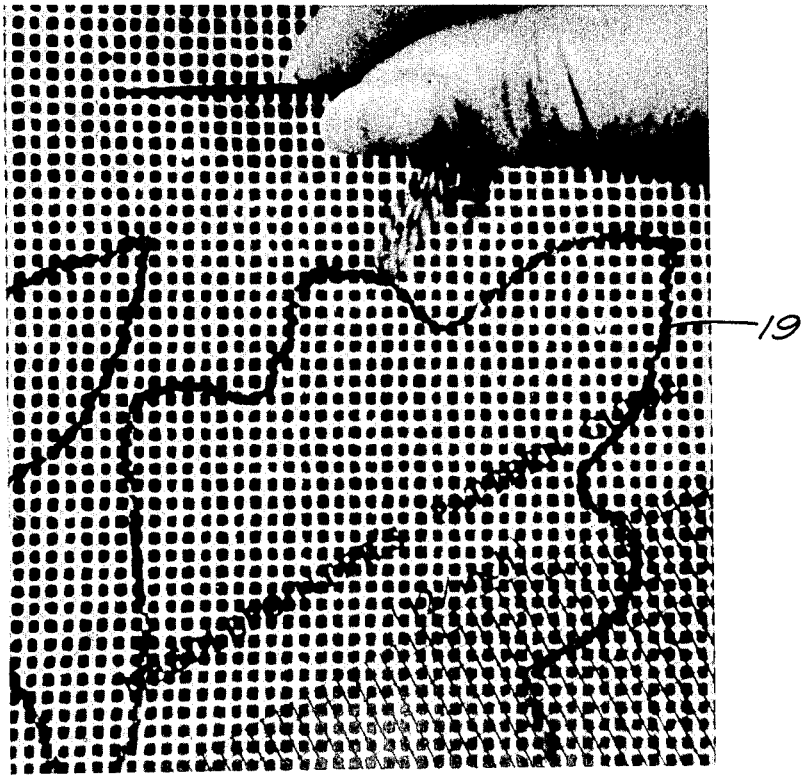
FIG. 7 is an illustration showing how the first stitch is completed after removal of the pattern guide.
Figure 8:
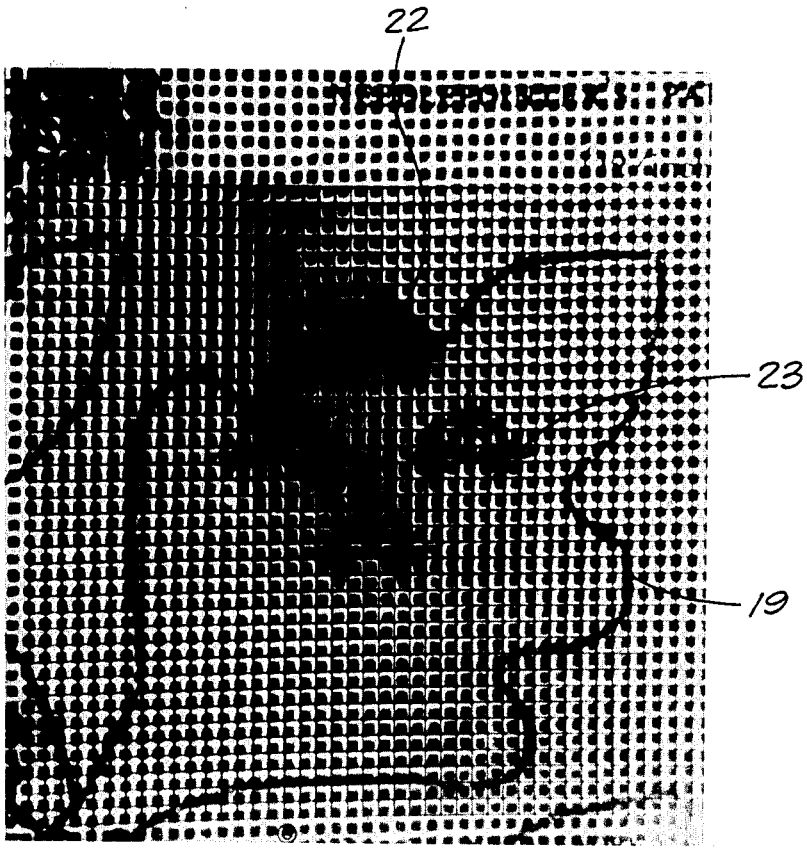
FIG. 8 is an illustration showing the technique of locating the starting hole for a second identical pattern in correct juxtaposition with a completed one.

The pattern guide 17 is then laid upon the canvas to which the pattern is to be transferred, on which the outline of the design has been delineated as indicated at 19 in FIGS. 6, 7 and 8. With the grid 18 congruent with the threads of the canvas and the traced stitch lines positioned over the area to which the pattern is to be applied, a threaded needle is passed from the underside of the canvas through the canvas hole underlying the end of a stitch line trace overlaid by the traced pattern. The pattern guide then is removed, the first stitch is completed, and the remaining stitches of the traced pattern are applied, referring to the traced pattern for the stitch lengths and relative orientation.

For extensions of the application of the same pattern to a larger area it is necessary only to align a portion of the tracings on the pattern guide 17 with a portion of the already stitched pattern on the canvas in the desired offset relation therewith, and to apply as many whole or partial repeats of the pattern as necessary to fill the allocated area.

The manner in which this is accomplished is illustrated in FIGS. 6, 7 and 8 showing the application of a simple triad of asterisks design. In FIG. 6, with the pattern guide 17 overlying the canvas on which the outlines of the design are delineated, as at 19, the starting hole indicated by the arrow 21 is located and the needle is positioned in it from the back of the canvas. The pattern guide is then removed and the needle is pulled to the front of the canvas, as shown in FIG. 7. Referring to the pattern card 12 for stitch lengths and orientation, the first repeat of the pattern then is completed.

To locate subsequent repeats of the same pattern, the pattern guide, carrying the pattern traced on it, is replaced over the pattern area, as shown in FIG. 8, with its grid congruent with the threads of the canvas and one group of traced stitches 22 of the pattern overlying and in alignment with a repeat already stitched into the canvas; the remaining traced stitches 23 overlying an unstitched area to which the pattern is to be extended. The additional repeats of the pattern are then applied in the same way as those first applied.

Figure 2:
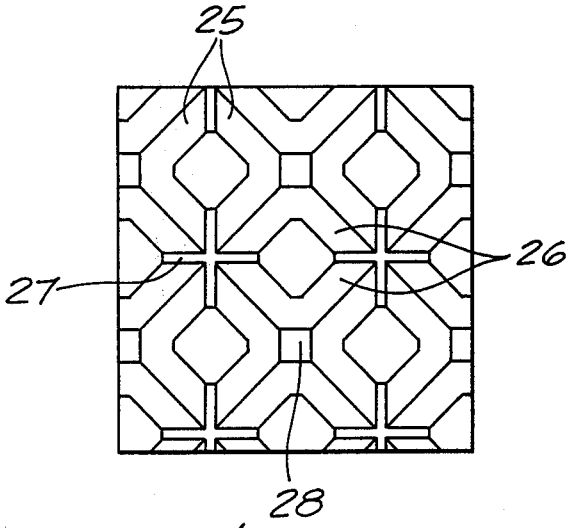
FIG. 2 is an illustration of a more complex pattern.
Figure 4A:
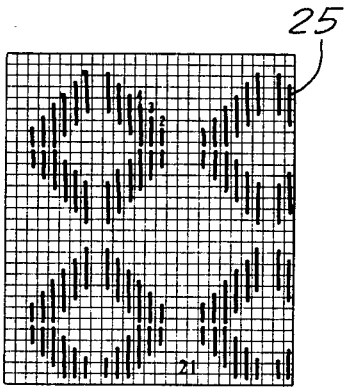
FIGS. 4*a*, 4*b* and 4*c* are illustrations of a pattern card for the application of a pattern such as that of FIG. 2.
Figure 4B:
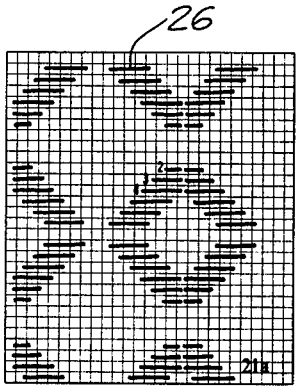
Figure 4C:
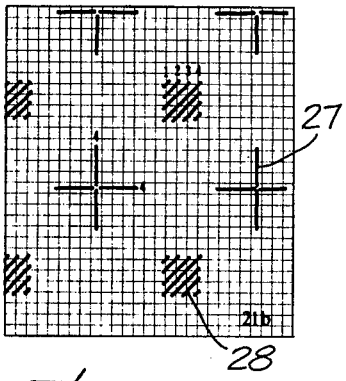

If each pattern component involves the use of a different pattern stitch, whether or not different colors are to be used, then each is diagrammed separately. For example, for transfer of the pattern of FIG. 2 which is to be reproduced in three different colors, each stitched differently, the pattern card diagrams of FIGS. 4*a*, 4*b* and 4*c* are provided. After one of these pattern elements such as 25 has been stitched into the canvas in the selected area or areas of the whole design, a second one, such as 26, is traced onto the pattern card 12, aligned in its proper relationship with that already stitched, and stitched into the canvas. The last pattern elements 27 and 28 then are traced, positioned and stitched in the same way.

In the course of transferring patterns by this method, the traced diagram may be moved around freely to see exactly what the pattern will look like in any given area. Guessing as to whether the pattern will or will not fit in a selected area thus is eliminated. Checking for accuracy of stitch placement is simplified; it being effected by merely overlaying the pattern guide trace on a stitched area.

At edges 19 of the design outline where full stitches cannot be taken, guess work is eliminated because, by positioning the pattern guide trace at an edge 19, the exact length and location of each partial stitch is clearly indicated.

With the foregoing description of the preferred ways of carrying out the method of the present invention, its essential features and advantages will be readily understood by those familiar with the needleworking art, and changes in the details of application of the method may, of course, be resorted to within the scope of the following claims.

I claim:

1. A method of transferring a repetitive pattern from a source to a mesh fabric base including the steps of applying stitch length tracings of said pattern to a transparent sheet which has delineated thereon a grid of the same mesh size as said fabric base, aligning the grid of said transparent sheet with the mesh of said fabric base with the traced pattern overlying the location on the fabric base to which the pattern is to be transferred, and embroidering threads into the fabric base underlying the stitch length tracings on the transparent sheet.

2. A method according to claim 1 in which at least two repeats of said pattern are applied by tracing to said transparent sheet.

3. A method according to claim 2 in which following embroidering of said two repeats of said pattern into the fabric base, the transparent sheet is repositioned so that one traced delineation of said pattern overlies a stitched representation of it on the canvas and a second traced delineation overlies an unstitched area of the fabric base.

4. A method of transferring in stitches to a mesh fabric base a multicolor pattern in which each color is to be stitched in a different color and with a different pattern stitch, including the steps of providing a separate diagram on a grid background of the same mesh size as said fabric base, of stitch length delineations of those portions of the pattern to be stitched in each color, tracing the delineations from a first one of said diagrams onto a transparent sheet which has delineated thereon a grid of the same mesh size as said fabric base, aligning the grid of said transparent sheet with the mesh of said fabric base with the traced delineations overlying the location on the fabric base to which the pattern is to be transferred, embroidering threads of one color into the fabric base underlying the tracings on the transparent sheet, tracing the delineations from a second one of said diagrams onto a transparent sheet which has delineated thereon a grid of the same mesh size as said fabric base, aligning the grid of the transparent sheet carrying the tracing of the second of said diagrams with the mesh of said fabric base with said tracings in the desired relationship to the said embroidered threads, and embroidering threads of a contrasting color into the fabric base underlying the tracings of the second of said diagrams on the transparent sheet.

5. A method according to claim 4 in which at least one of said diagrams is of at least two delineations of those portions of the pattern to be stitched in one color.

* * * * *